United States Patent [19]

Sorenson

[11] Patent Number: 4,942,272

[45] Date of Patent: Jul. 17, 1990

[54] TOGGLE SWITCH WITH SELF-LOCKING FEATURE

[75] Inventor: Richard W. Sorenson, Avon, Conn.

[73] Assignee: Carlingswitch, Inc., Plainville, Conn.

[21] Appl. No.: 337,305

[22] Filed: Apr. 13, 1989

[51] Int. Cl.[5] ..... H01H 3/20

[52] U.S. Cl. ..... 200/43.16; 200/315

[58] Field of Search ..... 200/43.16, 339, 321, 200/327, 315

[56] References Cited

U.S. PATENT DOCUMENTS 4,215,257 7/1980 Repplinger ..... 200/43.16

4,291,211 9/1981 Discenza ..... 200/315

4,480,159 10/1984 Kirchoff ..... 200/43.16

*Primary Examiner*—Renee S. Luebke

*Attorney, Agent, or Firm*—McCormick, Paulding & Huber

[57] ABSTRACT

A toggle switch has a toggle pivotably mounted in a threaded boss of the switch case. The toggle is preferably translucent so light from an internal lamp can reach the top of the toggle. A sleeve is slidably received on the toggle and has an inner end that is shaped to cooperate with an upper end of the boss to define discrete toggle positions. A spring biases the sleeve into a locked position engaging these shaped end portions.

4 Claims, 3 Drawing Sheets

TOGGLE SWITCH WITH SELF-LOCKING FEATURE

This invention relates generally to toggle switches having means provided on the external portion of the toggle to lock the toggle in a given switch position. More particularly, the present invention relates to a lockable toggle wherein means is defined in part on the toggle itself and in part on the cover or bushing that supports the toggle to provide this locking function.

SUMMARY OF INVENTION

In accordance with the present invention and in the presently preferred environment for a toggle of the present invention a conventional switch base is provided with a cavity having fixed and movable switch contacts. A cover bracket encloses the base cavity and defines a central bushing that may be threaded to permit mounting of the switch case in a panel. A toggle is pivotably supported in the bushing and has an inner end adapted to move the movable contact or contacts. The toggle includes an upper portion that slidably receives a sleeve movable lengthwise of the projecting toggle portion. A spring biases the sleeve toward the bushing and the sleeve has inwardly facing abutment surfaces engageable with correspondingly shaped surfaces on the outer end of the bushing to define two or more positions for the toggle when these abutment surfaces are in engagement with one another. The sleeve can be manually pulled back against the force of the spring to permit movement of the toggle between the various switch positions.

DETAILED DESCRIPTION

Figure 3:
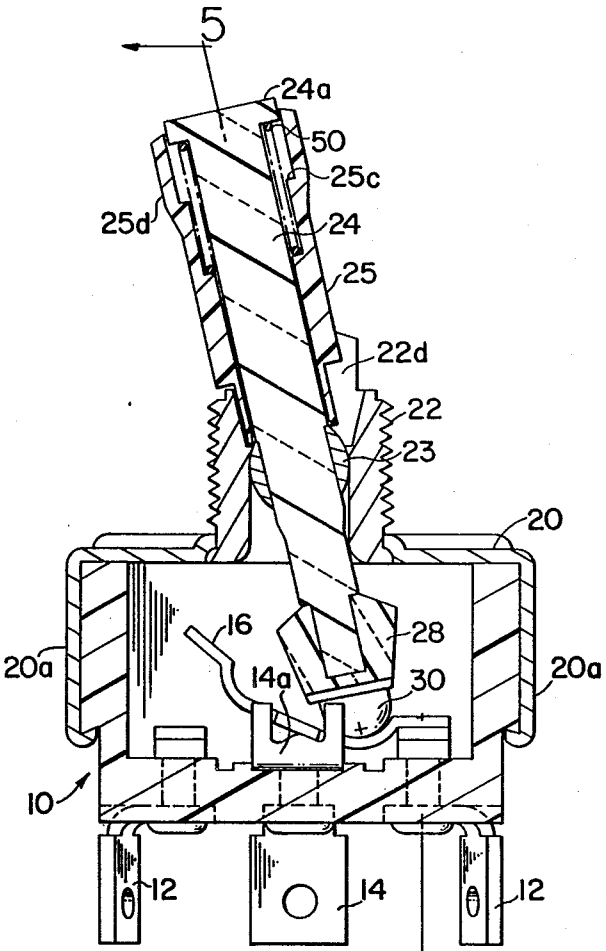
FIG. 3 is a vertical section view also taken through the toggle switch of FIG. 1, but generally on the line 3—3 of FIG. 5.
Figure 2:
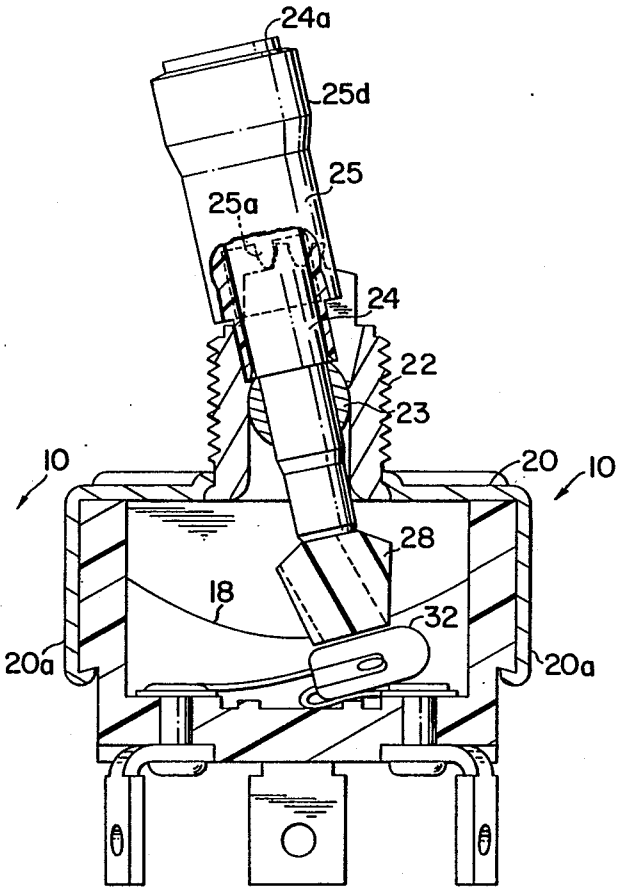
FIG. 2 is a vertical section taken through the toggle switch of FIG. 1, and more particularly on line 2—2 of FIG. 5.
Figure 1:
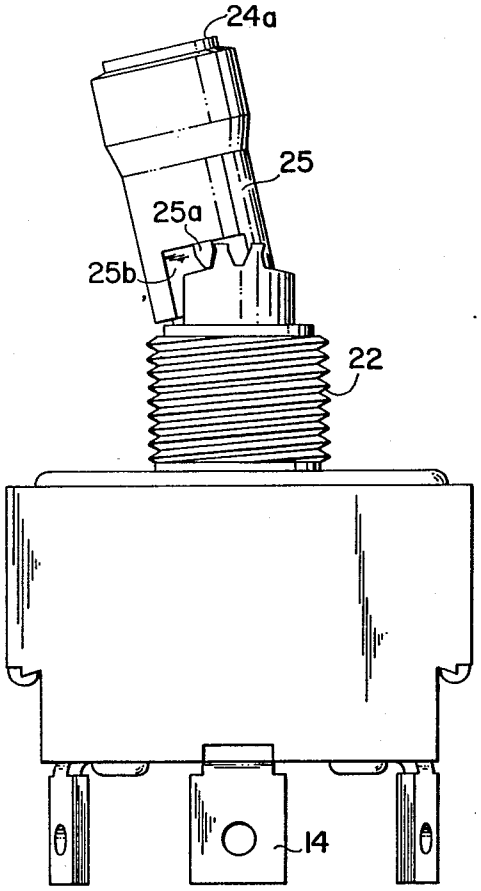
FIG. 1 is an elevational view of an electric toggle switch constructed in accordance with the present invention and shows the toggle in one of several alternative positions.

Referring now to the drawings in greater detail, FIGS. 1, 2, 3 and 5 illustrate a switch comprising a rectangular case 10 having spaced parallel side walls, and parallel end walls molded integrally with a bottom wall that defines a floor of an upwardly open cavity. Fixed switch contact elements are provided in this bottom wall or floor. A center fixed contact element 14 includes an inner portion **14*a* providing a fulcrum for the movable switch contact element 16. Fixed contact elements 12, 12 are each adapted to be engaged by the movable contact element 16 depending upon the position of the toggle 24**. The number of fixed contacts is optional, but in the three position switch shown at least two are provided per pole. However, it should perhaps be noted that the advantages of the present invention can also be realized in a two position switch having only one such fixed contact.

In the switch case shown a vertical partition 18 is provided to isolate the two pole case configuration, and the upper edge of this partition is concave so as to guide an actuator 28 and to divide the switch case into separate parallel switch compartments. As so constructed and arranged the switch case is preferably made of a thermoplastic material or other insulating material and the electrically conductive fixed contact elements 12, 12 are secured in the bottom wall by any convenient means.

The open top of the switch case is covered by a metal cover plate 20 having integrally formed downwardly extending legs **20*a* the lower ends of which legs are bent inwardly to engage shoulders defined in the end walls of the switch case 10. The cover plate 20 has a central aperture in which an upwardly extending threaded bushing or boss 22 is secured. This bushing or boss defines an inwardly extending shoulder 22*f* adjacent its upper end to provide an arcuately shaped annular bearing seat for a ball 23 fitted on the toggle element 24**.

In accordance with the present invention the upper end of the bushing 22 includes upstanding laterally spaced abutments **22*a* and 22*b* that cooperate with a lower end portion of sleeve 25. The sleeve 25 is slidably received on the toggle 24** for limited sliding movement thereon.

Figure 5:
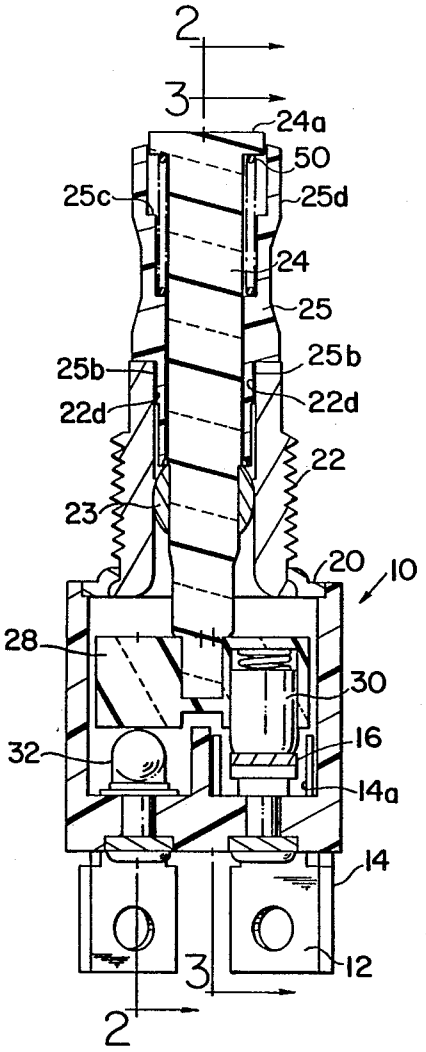
FIG. 5 is a generally vertical section taken on the line 5—5 of FIG. 3.
Figure 8:
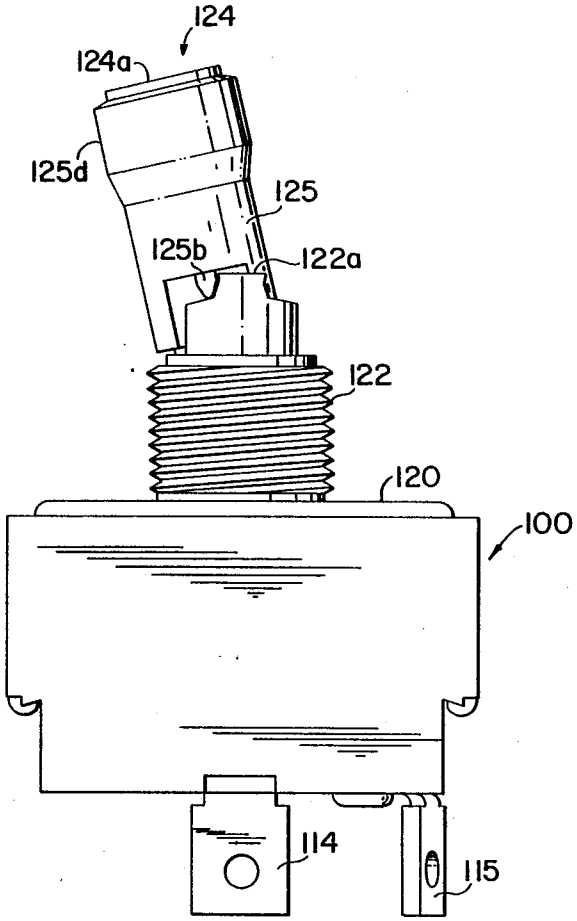
FIG. 8 is an elevational view of an alternative electric toggle switch construction.
Figure 6:
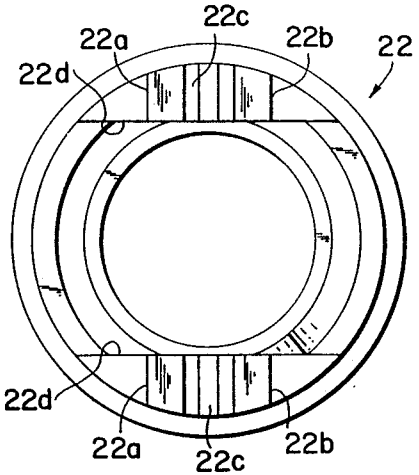
FIG. 6 is a top plan view of the upper end of the switch case bushing as seen from the directional line 6—6 in FIG. 4B.
Figure 7:
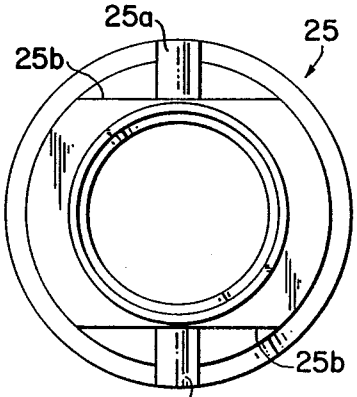
FIG. 7 is a bottom plan view of the lower end of the sleeve as seen from the directional line 7—7 of FIG. 4.

The lower end of the toggle 24 passes through the ball shaped collar 23 and the lowermost end of the toggle is secured to an actuator 28. The actuator 28 has generally rectangular lateral end portions that serve to restrict the motion of it and the toggle to pivotal motion in a plane oriented parallel to the side walls of the switch case 10. The actuator 28 has at least one spring loaded plunger 30, as best shown in FIG. 5, that is adapted to engage the movable contact lever 16 in order to define one of the three positions for the switch as shown in FIGS. 4s 4A, 4B and 4C. The number of switch positions depends upon the application for the particular switch itself. FIG. 8 shows a two position switch for example, but in FIGS. 1–7 a three position is shown and will be described in detail.

The toggle element 24 and its associated actuator 28 are preferably made of a transparent plastic material in order to permit light from a lamp 32 to pass upwardly through the actuator 28 and the toggle 24 in order that the upper or extreme end portion of the toggle illustrated generally at **24*a* can be illuminated to indicate the condition of the switch. While the actuator and toggle can be of one piece construction such a construction would require that the outer or upper toggle portion be small enough to pass through the inside of the boss 22 at assembly of these components. In any event the toggle is preferably formed from a transparent or translucent thermoplastic material so as to convey light from the lamp 32 upwardly to the top or upper end portion 24*a* of the toggle 24**.

Figures 4A, 4B, 4C:
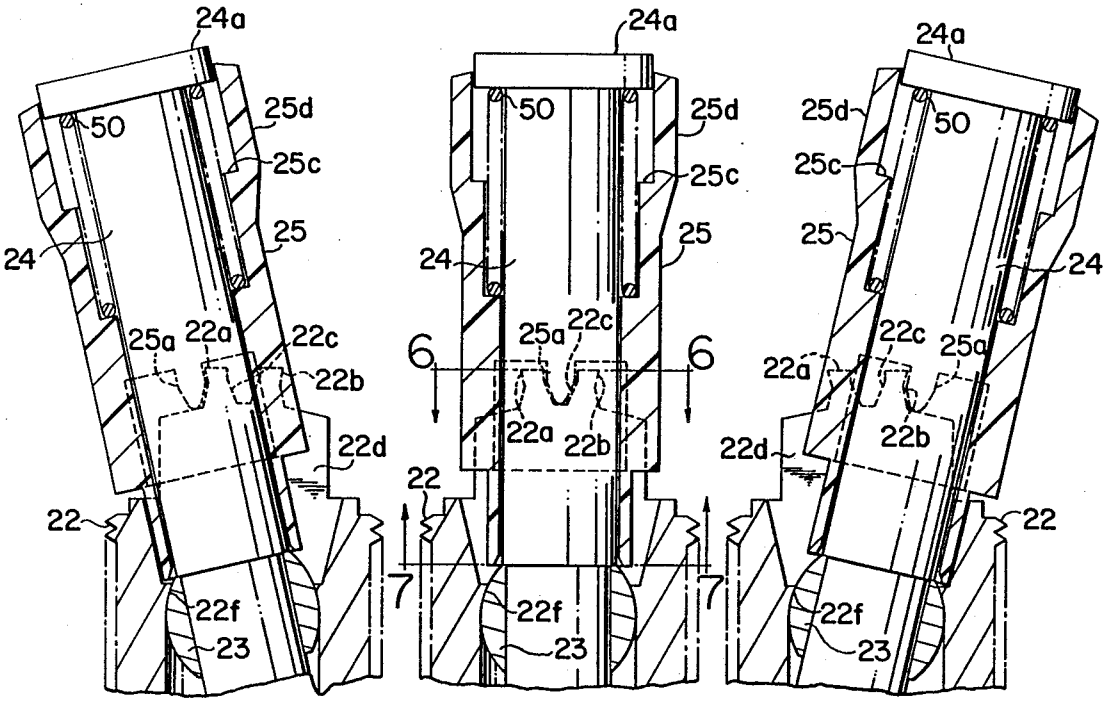
FIGS. 4A, 4B and 4C are a series of enlarged views showing details of the toggle and sleeve and illustrating the cooperation between the sleeve and the upper end of the switch case bushing.

Thus, movement of the toggle 24 and its associated sleeve 25 from and to the alternative positions illustrated in FIGS. 4A, 4B and 4C will selectively cause light from the lamp source 32 to reach the upper end of the toggle 24. Window defining means in the form of a shield (not shown) may be provided over the lamp 32 in order that illumination be directed to a particular portion of the actuator 28. Actuator 28 may also be provided with wing portions (not shown) to permit the upper end of the toggle 24*a* to be illuminated in more than one position or with differently colored light in certain switch positions.

Referring now to FIGS. 4A, 4B and 4C in greater detail, in the three position switch shown each of the laterally spaced abutment walls 22*a* and 22*b* of the bushing 22 define detent means 22*c* for cooperating with a downwardly projecting protrusions 25*a*, 25*a* in sleeve 25. These protrusions 25*a*, 25*a* cooperate with abutment walls 22*c* and 22*b* along with detent 22*c* on upstanding fixed bushing 22 to define the switch positions suggested in FIGS. 4A, 4B and 4C. That is, the protrusions 25*a*, 25*a* comprise inwardly facing end surface of the sleeve 25 and are engageable with abutment surfaces 22*a* and 22*b* defined for this purpose on the bushing 22 outer end in order to prevent movement of the toggle 24 when these sleeve surfaces and bushing abutment surfaces are held in engagement by a spring 50 that acts between the sleeve 25 and a flange defined at the upper end of the toggle 24*a*.

As mentioned previously the sleeve 25 is slidably received on the actuator 24 for movement between the position shown and a position wherein the sleeve 25 is lifted upwardly relative to the toggle 24 so that a stop surface 25*c* engages the underside of the flanged upper end portion 24*a* of the toggle 24. As mentioned previously the toggle 24 is free to move pivotably but is restrained from outward movement relative to the case by engagement of the collar 23 and the shoulder provided for this purpose inside the bushing 22.

The sleeve 25 includes a flared upper end portion as indicated generally at 25*d*. This flared portion 25*d* allows the user to place his thumb on the upper end portion 24*a* of the toggle, and to use his fingers to pull the sleeve upwardly for unlocking the toggle in order to change switch condition.

Means is preferably provided for preventing rotation of the toggle in the switch case and more particularly relative to the bushing 22. Such means preferably takes the form of flat surfaces 22*d*, 22*d* provided respectively on the upstanding laterally spaced abutment defining surfaces of the bushing as indicated generally in FIG. 6. FIG. 5 illustrates these surfaces 22*d*, 22*d* as they cooperate with corresponding flat surfaces 25*b*, 25*b* provided for this purpose at the lower external end portion of the sleeve 25. This construction avoids rotation of the sleeve relative to the generally cylindrical toggle 24. The toggle itself is prevented from rotating in the boss 22 by reason of the lower end of the toggle being fitted with the actuator portion 28. This actuator portion has laterally spaced end portions that are flat and engage the flat inside side walls of the case to avoid any tendency for the toggle to rotate.

FIG. 8 shows an alternative switch construction of the two position type. The switch case 100 is fitted with a cover bracket 120 that includes a boss 122. In the ON/OFF switch shown only center contact 114 and contact 115 are required. A movable contact (not shown) spans these fixed contacts 114 and 115 in the switch ON position shown. The toggle inside sleeve 125 has a lower portion for moving the movable contact and this sleeve 125 has two laterally spaced protrusion 125*b* that cooperates with the abutments 122*a* to define the two (ON/OFF) switch positions. As in the previously described embodiment a flared portion 125*d* of sleeve 125 provides a convenient finger engageable portion of the sleeve such that the user can place his thumb on the upper end 124*a* of toggle 124 to unlock the sleeve and change switch conditions as required.

Flat surfaces (not shown) are provided on the upstanding laterally spaced abutments 122*a*, 122*a* for cooperating with flats 125*b*, 125*b* on the sleeve 125 to prevent rotation of the sleeve on the toggle.

I claim:

1. An illuminated toggle switch comprising a base defining a cavity, fixed and moveable contacts in the cavity, a cover for the cavity including a central bushing, said bushing defining a toggle opening, a transparent generally cylindrically shaped toggle pivotally supported in said toggle opening, said toggle having an inner end portion in said cavity for moving said moveable contact in response to said pivotable toggle movement, said toggle having an outer portion protruding outwardly of said bushing, said bushing having an outer end defining abutment surfaces, a sleeve slideably received on said toggle outer portion and said sleeve having an outer end that is open, said toggle outer portion including an outer end portion defining an enlarged flange projecting beyond said sleeve outer open end, a spring acting between said toggle outer end flange portion and said sleeve to bias the sleeve toward said bushing, said sleeve having inwardly facing end surfaces engageable with said abutment surfaces of said bushing outer end to prevent movement of said toggle when said sleeve end surfaces and said bushing abutment surfaces are held in engagement by said spring, said bushing outer end abutment surfaces provided on both sides of said moveable toggle, and said inwardly facing surfaces on said sleeve having portions engageable with said bushing outer end abutment surfaces, said abutment surfaces defining at least two distinct sleeve positions, said bushing having parallel flat surfaces facing one another adjacent said abutment surfaces and said sleeve having complementary flat surfaces adjacent said sleeve flat surfaces to prevent rotation of said sleeve on said toggle, said sleeve being fabricated from an opaque material, and a lamp in said base cavity for internally illumining said generally cylindrical toggle so that the flanged outer end portion projecting above the sleeve is visible from the internal illumination of said lamp.

2. The switch according to claim 1 wherein said bushing abutment surfaces define at least three distinct sleeve positions, and wherein toggle movement is prevented when said sleeve is held in one of said three positions by said spring biasing said sleeve toward said bushing.

3. The switch according to claim 2 wherein said cylindrical toggle is of gradually increasing diameter from its inner end to its outer flanged end portion, and the switch further comprising a generally spherical ball element with an internal cylindrical bore for receiving said toggle element and serving to pivotally support said toggle in said bushing.

4. The switch according to claim 3 wherein said cylindrical toggle is restricted from rotational movement on its longitudinal axis by means external to the toggle itself so as not to interfere with the transmission of light from the lamp through said transparent toggle.

* * * * *